United States Patent [19]

Burdick

[11] 4,291,639

[45] Sep. 29, 1981

[54] ELECTRICAL ISOLATION SYSTEM FOR THE MAST AND SHROUDS OF A SAILBOAT

[76] Inventor: Glenn A. Burdick, 701 County Rd. 80 West, P.O. Box 221, Tarpon Springs, Fla. 33589

[21] Appl. No.: 1,948

[22] Filed: Jan. 8, 1979

[51] Int. Cl.[3] ..... B63B 35/00; B63H 9/00

[52] U.S. Cl. ..... 114/39; 114/90; 114/103; 114/111; 114/102; 174/177; 174/208; 174/138 D; 174/85

[58] Field of Search ..... 174/2, 3, 4, 5 R, 177, 174/208, 138 D, 85; 114/39, 102, 103, 111, 89, 90, 93, 94, 220; 343/709, 885, 710, 890

[56] References Cited

U.S. PATENT DOCUMENTS

| | | | |
|---|---|---|---|
| 11,217 | 7/1854 | Forbes | 114/90 |
| 159,105 | 1/1875 | Light | 114/93 |
| 403,482 | 5/1889 | O'Bierne | 174/138 D |
| 481,912 | 8/1892 | Noll | 174/85 |
| 1,039,122 | 9/1912 | Hagborg | 114/90 |
| 1,304,342 | 5/1919 | Martin | 174/177 |
| 1,426,337 | 8/1922 | Sperry | 343/709 |
| 2,204,026 | 6/1940 | Peters | 343/885 |
| 2,519,230 | 8/1950 | Crankshaw | 114/90 |
| 3,105,870 | 10/1963 | Raila | 174/177 |
| 3,505,967 | 4/1970 | Peterson | 114/90 |
| 3,990,013 | 11/1976 | Badger | 174/138 D |

*Primary Examiner*—Trygve M. Blix
*Assistant Examiner*—D. W. Keen
*Attorney, Agent, or Firm*—Ward, Lalos, Leeds, Keegan and Lett

[57] ABSTRACT

An electrical isolation system is disclosed for use on sailboats having metal masts and shrouds for preventing accidental shocking or electrocution of persons who contact lower portions of the mast or shrouds and/or electrical conductors appended thereto when the top of the mast or shrouds come into contact with an electrical high voltage distribution or transmission line with the system including an insulating member separating the upper portion of the mast from a lower portion of the mast.

11 Claims, 15 Drawing Figures

FIG-1
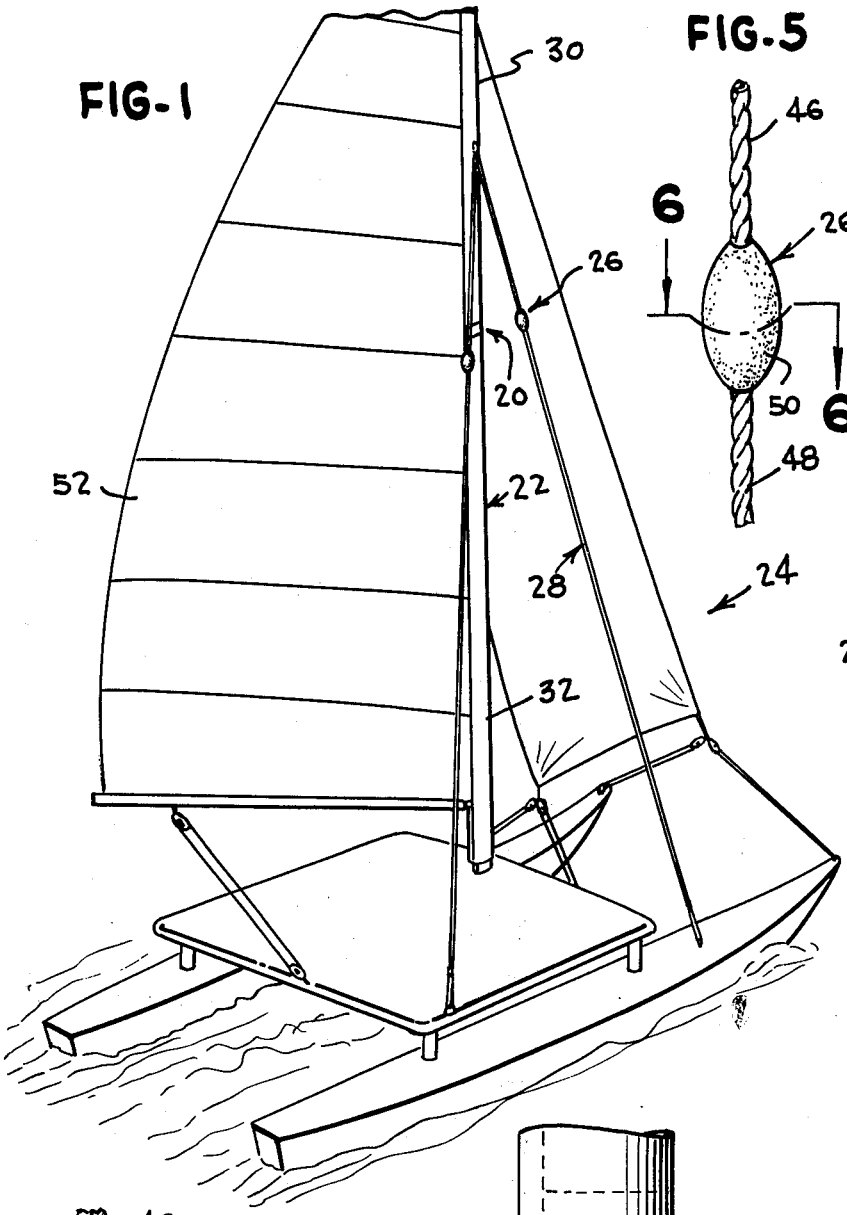
FIG-5
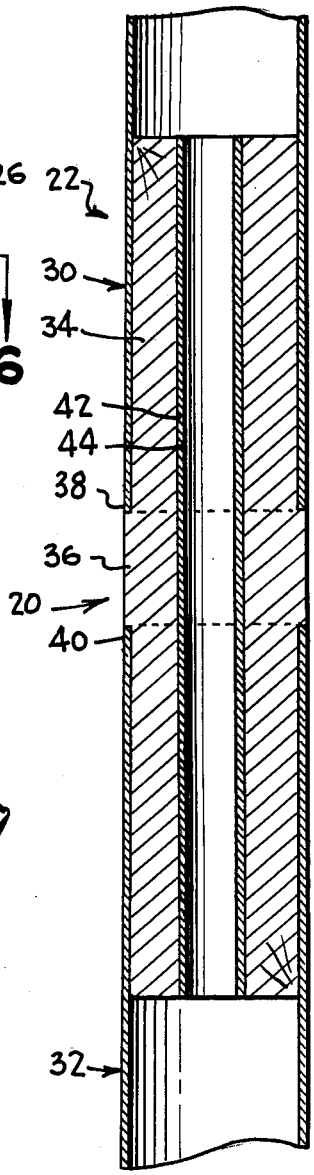
FIG-4
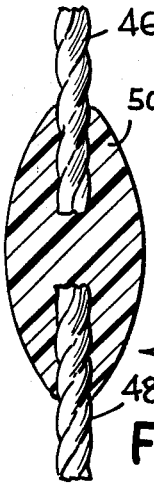
FIG-7
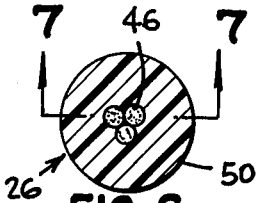
FIG-6
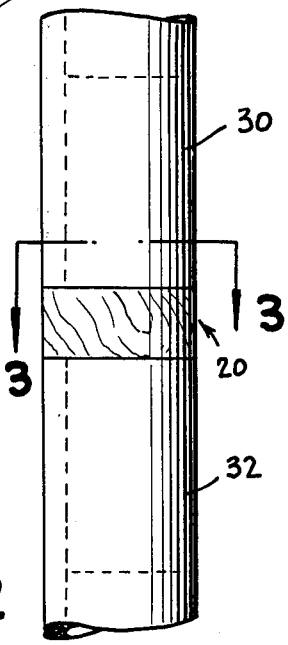
FIG-2
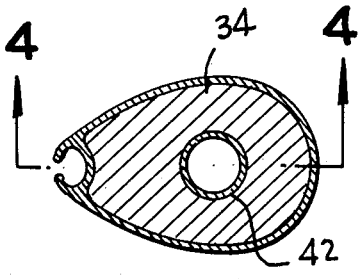
FIG-3

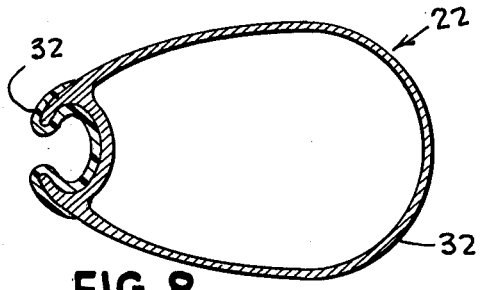
FIG-8
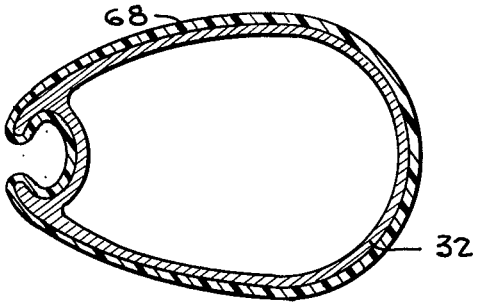
FIG-13
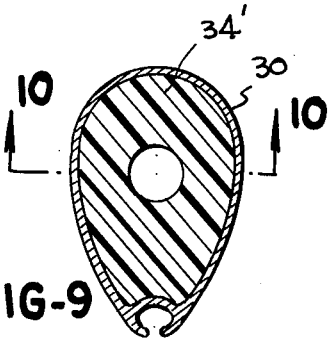
FIG-9
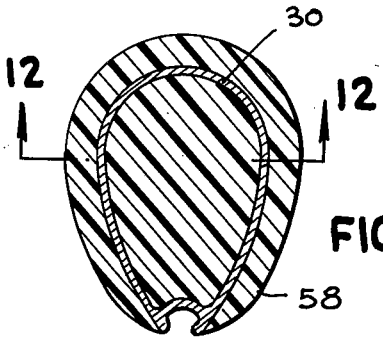
FIG-11
FIG-10
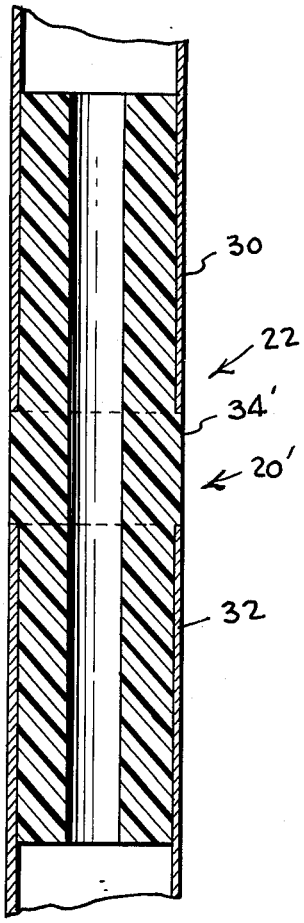
FIG-12
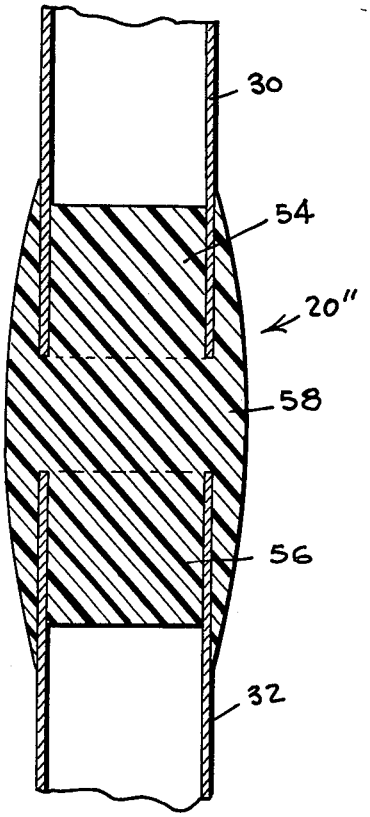
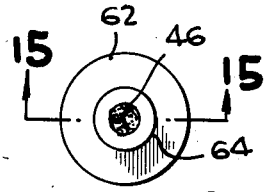
FIG-14
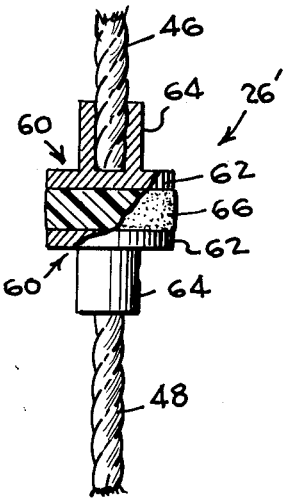
FIG-15

ELECTRICAL ISOLATION SYSTEM FOR THE MAST AND SHROUDS OF A SAILBOAT

BACKGROUND OF THE INVENTION

This invention relates to sailboats and more particularly to an electrical isolation system for preventing shocks and electrocutions caused by contacting high voltage distribution or transmission lines with the mast or shrouds of a sailboat.

With the advent of aluminum masts and sailboats which can be easily transported on trailers, shocks and electrocutions have been experienced by persons contacting portions of the mast or shrouds when they accidentally contact a high voltage distribution or transmission line. These accidents have occurred around launching sites and beach areas when a sailboat is being maneuvered to place it into or take it out of the water. Such accidents have also occurred when a sailboat is in the water and the mast or shrouds contact a high power line adjacent or extending over the waterway.

Accordingly, it is the principal object of this invention to provide a novel electrical isolation system for use on sailboats having metal masts and shrouds.

Another object of the present invention is to provide a system for use on sailboats for preventing accidental shocking or electrocution of persons who contact lower portions of the masts and shrouds and/or electrical conductors appended thereto when upper portions of the mast or shroud come into contact with an electrical high voltage distribution or transmission line.

A further object of the present invention is to provide an electrical isolation system for use on sailboats having metal masts and shrouds and/or electrical conductors appended thereto for preventing electrical injury to occupants of the boats while sailing in areas having overhead power transmission lines which may accidentally contact the mast or shroud and/or electrical conductors appended thereto on the sailboat.

A still further object of the present invention is to provide a simple and economical system for preventing electrical injury to persons in contact with the mast or shrouds and/or electrical conductors appended thereto.

Obtainment of the objects of this invention is enabled through the provision of a structural insulating member separating an upper portion from a lower portion of the mast and separating upper portions of the shrouds from lower portions of the shrouds.

A better understanding of the manner in which the preferred embodiment of the invention achieves the objects of the invention will be enabled when the following written description is read in conjunction with the appended drawings in which:

FIG. 1 is a perspective view of the preferred embodiment on a catamaran sailboat;

FIG. 2 is a fragmentary enlarged side elevational view of a portion of the mast incorporating the present invention;

FIG. 3 is a cross-sectional view taken along lines 3—3 in FIG. 2;

FIG. 4 is a cross-sectional view taken along lines 4—4 in FIG. 3;

FIG. 5 is a fragmentary enlarged view of a portion of the shrouds shown in FIG. 1 incorporating the present invention;

FIG. 6 is a cross sectional view taken along lines 6—6 in FIG. 5;

FIG. 7 is a cross-sectional view taken along lines 7—7 in FIG. 6;

FIG. 8 is a cross-sectional view, similar to FIG. 3, of the mast incorporating an insulating member for preventing the conduction of electricity through the sail of a sailboat;

FIG. 9 is an alternative embodiment of the invention as shown in FIG. 4;

FIG. 10 is a cross-sectional view taken along lines 10—10 in FIG. 9;

FIG. 11 is a cross-sectional view, similar to FIG. 3, showing an alternative embodiment of the present invention;

FIG. 12 is a cross-sectional view taken alone lines 12—12 in FIG. 11;

FIG. 13 is an alternative embodiment of the invention as shown in FIG. 8;

FIG. 14 is an alternative embodiment of the shroud insulating members as shown in FIG. 5; and FIG. 15 is a cross-sectional view taken along lines 15—15 in FIG. 14.

Attention is initially invited to the various figures of the drawings illustrating the preferred embodiment of the invention which includes a mast insulating joint member 20 in the mast 22 on a catamaran sailboat 24, which illustrates the present invention, and shroud insulating members 26 mounted in shrouds 28.

The mast insulating joint member 20, as shown in FIGS. 1 through 4, electrically isolates an upper portion 30 of the mast from a lower portion 32 of the mast. As shown in FIGS. 2, 3 and 4, the mast 22 is formed of extruded aluminum and has been separated at the desired location to form the upper portion 30 and the lower portion 32 with the cut being made at a location which is sufficiently high up on the mast to avoid the possibility of a person contacting the mast when it has come in contact with a voltage source and low enough to be below minimum allowed height of distribution and transmission lines.

The insulating member 20 includes a wooden core or other suitable electrical insulator 34 shaped to conform to the interior surface of the upper portion 30 and lower portion 32 of the mast 22, as shown in FIGS. 3 and 4. A raised shoulder 36 around the center portion of the core 34 contacts the lower end 38 of the upper portion 30 and the upper end 40 of the lower portion 32 of the mast when the mast is assembled as shown in FIG. 2. The raised shoulder 36 separates the upper portion 30 from the lower portion 32 a sufficient distance to prevent flashover caused by the difference in potential between the two portions as occurs when the mast comes in contact with a high voltage line. The core 34 may be formed of any wood or other electrical insulating material having the desired characteristics such as hickory, douglas fir, southern yellow pine, hard maple, oak, cypress, or hemlock. The insulating member 34 includes a steel or stainless steel tube (reinforcing tube may be constructed of any material having desired flex and strength) 42 bonded in a bore extending axially therethrough with the exterior surface of the tubine 42 sandblasted with coarse grit to enhance bonding of a resin 44 to the metal with the resin bonding the tubing to the wood core 34.

The interior of the upper and lower portions 30 and 32 of the mast adjacent the insulating member 34 are sandblasted with coarse grit to enhance bonding of the resin which is applied to the core 34 to bond the core to the mast. The core may be formed with smaller dimensions than the interior of the mast and encapsulated with fiberglass mat and resin to provide additional reinforcement and bonding of the insulating member to the mast.

Referring now to the shroud insulator 26 shown in FIGS. 5, 6 and 7, the insulator 26 transmits the load from the upper cable stay 46 to the lower cable stay 48 while electrically isolating the upper stay from the lower stay. The insulator 26 may be formed of a fiberglass reinforced resin or other suitable electrical insulator as required to produce the desired structural and electrical characteristics. As can be seen from FIG. 7, the upper stay 46 extends into the insulator 50 a sufficient distance to provide adequate bonding between the insulator and the stay while providing a sufficient separation between the upper stay 46 and the lower stay 48 to prevent flashover when one of the stays or the mast comes in contact with the high voltage source. The bonding and/or attachment of insulator to stay can be accomplished in a variety of ways using existing technology, including, but not limited to: swaging, pinning, bonding, welding, wire wrap, etc.

The mast 22, as illustrated in FIG. 8 showing the lower portion 32, may include a sail track insulator 32 which is formed of a coat of resin such as Teflon, polyurethane, polyethylene, polypropylene, polyester, epoxy, polyamide or the like applied to the sail track on the mast 22 especially in the area of the mast insulating member 20 to prevent the leakage of current through the sail 52 around the insulating member 20. Additionally, the edge of the sail could be treated with a moisture repellant and electrically insulating material which is flexible to prevent changing the performance characteristics of the sail. Such an insulator could be formed of rubber, neoprene or one of the aforementioned resins or the like. The sail and halyard would preferably be formed of a non-moisture absorbing material such as dacron, nylon, polyurethane jacketed materials, etc.

Referring now to the alternative embodiment to the mast as shown in FIGS. 9 and 10, there is shown a core 34', which is similar to core 34, formed of a reinforced plastic insulating material thereby eliminating the reinforcing tube 42 shown in FIGS. 3 and 4.

A second alternative embodiment of the mast insulating member identified as 20'' is illustrated in FIGS. 11 and 12 and is formed of a reinforced plastic material such as fiberglass and resin. The alternative insulating member 20'' extends upwardly into the upper mast portion 30 to form a core 54 and downwardly into the lower mast portion 32 to form a core 56 with the cores 54 and 56 bonded to the inner surfaces of the upper mast and lower mast to transfer the structural loads from one portion to the other. Integrally formed with the cores 54 and 56 is a flash and surface current preventing collar 58 which surrounds the lower end of the upper mast 30 and the upper end of the lower mast 32 to provide additional bonding surface for transmitting the structural loads and to prevent any flashover from one portion of the mast to the other due to a voltage potential differential between the two portions. The collar would not be necessary in all applications and/or configuration.

The second embodiment of the shroud insulator designated 26' is shown in FIGS. 14 and 15 and includes a pair of end caps 60 formed of metal disc 62 with a concentric upstanding integral tube portion 64 swaged or bonded to the ends of the upper and lower shroud stays 46 and 48 respectively. The discs 62 are bonded to an insulating disc 66 which separates the caps 60 and transmits the structural loads therethrough while insulating the upper stay 46 from the lower stay 48.

There is shown in FIG. 13, a second alternative embodiment for insulating a sail track and mast in which an insulating layer 68 such as resin completely surrounds the mast and sail track. This embodiment is particularly desirable when a sail material is used which tends to conduct electricity around the mast insulating joint.

The present invention provides protection against electrical shock by persons in contact with the lower portions of the shrouds and mast when the upper portions accidentally come in contact with high voltage sources.

From the foregoing detailed description, it will be evident that there are a number of changes, adaptations and modifications of the present invention which come within the province of those skilled in the art. However, it is intended that all such variations, not departing from the spirit of the invention, be considered as within the scope thereof as limited solely by the appended claims.

I claim:

1. An electrical isolation system for use on sailboats having metal masts and shrouds for preventing accidental shocking or electrocution of persons who contact the lower portion of the masts and shrouds when an upper portion of the mast or a shroud come into contact with an electrical high voltage distribution or transmission line comprising a mast insulating member extending between an upper portion and a lower portion of said mast and a shroud insulating member extending between an upper and a lower portion of each shroud stay.

2. The electrical isolation system of claim 1 wherein said mast insulating member comprises a nonconductive material having a reinforcing tube extending therethrough parallel to said mast.

3. The electrical isolation system of claim 2 wherein said nonconductive material is wood.

4. The electrical isolation system of claim 1 wherein said mast insulating member comprises cores which extend into an upper portion and a lower portion of said mast integrally formed with a collar portion extending around outer surfaces on said upper and lower portions of said mast.

5. The electrical isolation system of claim 1 wherein said shroud insulating means comprises an insulating member surrounding and attached to an upper portion of said shroud stay and extending downwardly with the lower end thereof surrounding and fixed to a lower portion of said shroud stay.

6. The electrical isolation system of claim 1 wherein said shroud insulating means comprises a cap attached to a lower end of an upper portion of the shroud stay and a cap fixed to an upper end of a lower portion of a shroud stay with an insulating member extending therebetween to transmit the structural loads and prevent the conduction of voltage potential thereacross.

7. The electrical isolation system of claim 1 further comprising a means for insulating said upper and said lower portions of said mast from a sail mounted thereon.

8. The electrical isolation system of claim 7 wherein said insulating means comprises a coating of moisture repellant and electrical insulating material applied to at least a portion of a sail in an area adjacent said mast insulating member.

9. The electrical isolation system of claim 1 wherein said mast insulating member comprises nonconductive material which extends upwardly into the upper portion of said mast and downwardly into the lower portion and which is secured to said portions.

10. The method of electrically insulating a metal mast and shrouds on a sailboat comprising inserting electrically insulating materials intermediate the ends of the mast and shrouds at a distance substantially beyond a point for contact with persons on board.

11. The method of claim 1 further comprising coating a sail with a water repellant and electrically insulating material in the area adjacent said ends.

* * * * *